US006848228B1

(12) United States Patent
Williams

(10) Patent No.: US 6,848,228 B1
(45) Date of Patent: Feb. 1, 2005

(54) METHOD AND APPARATUS FOR MAKING FOAM BLOCKS AND FOR BUILDING STRUCTURES THEREWITH

(76) Inventor: Chester W. Williams, East 251 Church Point Dr., Shelton, WA (US) 98584

( * ) Notice: Subject to any disclaimer, the term of this patent is extended or adjusted under 35 U.S.C. 154(b) by 0 days.

(21) Appl. No.: 09/532,059

(22) Filed: Mar. 21, 2000

(51) Int. Cl.[7] ..... E04C 1/00

(52) U.S. Cl. ..... 52/309.9; 52/220.2; 52/405.1; 52/439; 52/503; 52/586.1; 52/605

(58) Field of Search ..... 52/649.1, 600, 52/564, 309.9, 220.2, 405.1, 439, 503, 562, 582.1, 586.1, 605

(56) References Cited

U.S. PATENT DOCUMENTS 2,269,018 A * 1/1942 Guignon ..... 52/309.7
2,285,165 A * 6/1942 Logeman ..... 52/331
2,392,551 A * 1/1946 Roe ..... 52/586.2
2,540,349 A * 2/1951 Reed ..... 52/410
3,788,020 A * 1/1974 Gregori ..... 52/309.12
4,038,798 A * 8/1977 Sachs ..... 52/309.7
4,075,808 A * 2/1978 Pearlman ..... 52/439
4,879,855 A * 11/1989 Berrenberg ..... 52/309.11
5,024,035 A * 6/1991 Hanson et al. ..... 52/591
5,123,222 A * 6/1992 Guarriello et al. ..... 52/309.12
5,459,971 A * 10/1995 Sparkman ..... 52/426
5,465,542 A * 11/1995 Terry ..... 52/309.7
5,802,793 A * 9/1998 DeVore, Jr. ..... 52/424
5,802,797 A * 9/1998 Storer-Folt ..... 52/604
5,839,249 A * 11/1998 Roberts ..... 52/745.08
5,881,524 A * 3/1999 Ellison, Jr. ..... 52/565
5,921,046 A * 7/1999 Hammond, Jr. ..... 52/564
6,164,035 A * 12/2000 Roberts ..... 52/563
6,240,693 B1 * 6/2001 Komasara et al. ..... 52/439
6,298,622 B1 * 10/2001 Cretti ..... 52/309.7
6,305,142 B1 * 10/2001 Brisson et al. ..... 52/742.14

* cited by examiner

*Primary Examiner*—Carl D. Friedman
*Assistant Examiner*—Chi Q. Nguyen
(74) *Attorney, Agent, or Firm*—Black Lowe & Graham, PLLC

(57) ABSTRACT

Foam blocks may be manufactured using a two part urethane foaming agent or the like at the construction site using a mold that may be disassembled into a plurality of component pieces for ease of transportation and to facilitate removal of a block. Preferably, the blocks are formed in the mold in which a facing is placed such that the facing is bonded to the foam of the block. A wall constructed from successive courses of blocks will have intersecting horizontal and vertical channels which may be filled with concrete and reinforcing rod to produce a wall with high horizontal and vertical load capacity as well as superior insulating properties.

19 Claims, 5 Drawing Sheets

METHOD AND APPARATUS FOR MAKING FOAM BLOCKS AND FOR BUILDING STRUCTURES THEREWITH

TECHNICAL FIELD

The present invention relates to methods and apparatus for making foam blocks and for using such foam blocks for constructing building structures, particularly wall structures, therewith.

BACKGROUND OF THE INVENTION

In many less developed countries, and in underdeveloped areas in many countries there is a need for building low cost housing units and other structures in an expeditious, cost-effective manner using local labor resources that may not be highly skilled and trained in modern construction methods. However, many of the present alternative construction methods in such areas, such as wood frame construction and concrete construction, require skilled labor and the hauling of substantial equipment and materials to the construction site.

Construction methods are known which use various types of foam forms and foam blocks. These forms and blocks contain voids that are filled with concrete and reinforcing rod ("rebar") and the forms or blocks are either removed or left in place. One such construction method, disclosed in U.S. Pat. No. 5,024,035 to Hanson, et al. uses blocks that may be made of urethane foam. Voids in the block construction are filled with rebar and concrete and the blocks are left in place to provide insulation. Another such method, taught by Reddi-Form, Inc., of Oakland, N.J. 07436, uses form blocks that lock together to form channels for receiving concrete and rebar. These form blocks are made of polystyrene foam. Buildings constructed using the systems of Reddi-Form, Inc. may be finished by attaching wood or other materials (such as wood, aluminum or vinyl siding, brick or stone, or stucco) to the outside surface of the construction. Other construction methods use sheets of foam connected by transverse members, the interior cavity formed by which is filled with concrete and rebar.

All of these systems have the benefit of providing sturdy, insulated structures that can be erected fairly quickly. However, they all require that the bulky foam blocks or forms and other materials be transported to the construction site. This is inconvenient for construction undertaken in underdeveloped or remote locations. Furthermore, the storage of the blocks at the source and at the construction site is inconvenient.

In addition to the foregoing, the prior construction systems do not provide an exterior finish on the blocks or forms. Thus, conventional exterior finishing methods, which may involve the use of bulky and expensive materials, may have to be used thereon.

SUMMARY OF THE INVENTION

The present invention is directed to a method and apparatus for manufacture of foam construction blocks on site for use in inexpensive, energy-efficient structures that may be conveniently and quickly erected in less developed areas without the need for highly skilled labor. The foam construction blocks may be formed with an integral facing made of cementitious grout or like material. In order to improve the adherence of the facing to the foam block, a wire mesh such as hardware cloth or chicken wire may be embedded in the grout.

The molds for making the blocks can be advantageously fabricated from a plurality of steel plates with appropriate fittings mounted thereon. When so constructed, the molds may be broken down for easy handling and transportation to the construction site. When the mold is reassembled, a facing may be positioned therein, together with mold spacers for creating voids in the blocks, and the components for making the foam may be added to the mold. The mixed components expand rapidly within the mold and bind to the facing.

The blocks may be stacked one on top of another or in a staggered configuration similar to that commonly used for cinderblock walls, in either event atop a concrete or like footing. Vertical and horizontal rebar (including rebar extending upward from the foundation) may be passed through the voids. The tying of the horizontal rebar to the vertical rebar using standard wire ties can create a grid of rebar which is sufficiently rigid that it can be used to secure the blocks against floating when the voids are filled with concrete. Blocks may be cut using a standard handsaw to form corners of any desired angle. Cutting devices capable of cutting the facing are known in the art and may be used to cut the facing to provide blocks of desired size. Door and window frames and lintels may be affixed to the blocks to terminate the channels formed between successive blocks.

The facings may be constructed using Portland cement or other cementitious grout in a simple horizontal mold. A removable frame forms the sides of the mold. The frame may be removed once the grout has sufficiently hardened to release the facing.

As the blocks have both vertical and horizontal voids that form channels running throughout the wall of a building constructed using the above method, the final structure has great resistance to both vertical and lateral loading.

DETAILED DESCRIPTION OF THE INVENTION

The present invention is generally directed toward apparatus and methods for making foam blocks and cementitious facings and molds for making such blocks and facings and structures built with such foam blocks. Many specific details of certain embodiments of the invention are set forth in the following description and in FIGS. 1–6 to provide a thorough understanding of such embodiments. One skilled in the art will understand, however, that the present invention may have additional embodiments, or that the present invention may be practiced without several of the details described in the following description.

In one embodiments of the invention, urethane foam building blocks are intended for manufacture at the construction site in order to avoid the need to transport to the bulky foam blocks to the site and in order to avoid potential breakage and other damage to the blocks from transportation and storage. One person can operate a plurality of such molds on-site to make one block per mold per hour. Thus, with ten molds, a single individual should be able to make about 80 blocks with 8 hours of labor. As the blocks may be of larger size than standard cinder blocks, in one embodiment being about 16 inches (41 cm) in height by 32 inches (81 cm) in width by 8¼inches (22 cm) in depth, sufficient blocks to construct a substantial wall can be produced by a single individual in one day. Accordingly, molds are provided which can be quickly assembled and disassembled for ease of transportation to the construction site.

Figure 1:
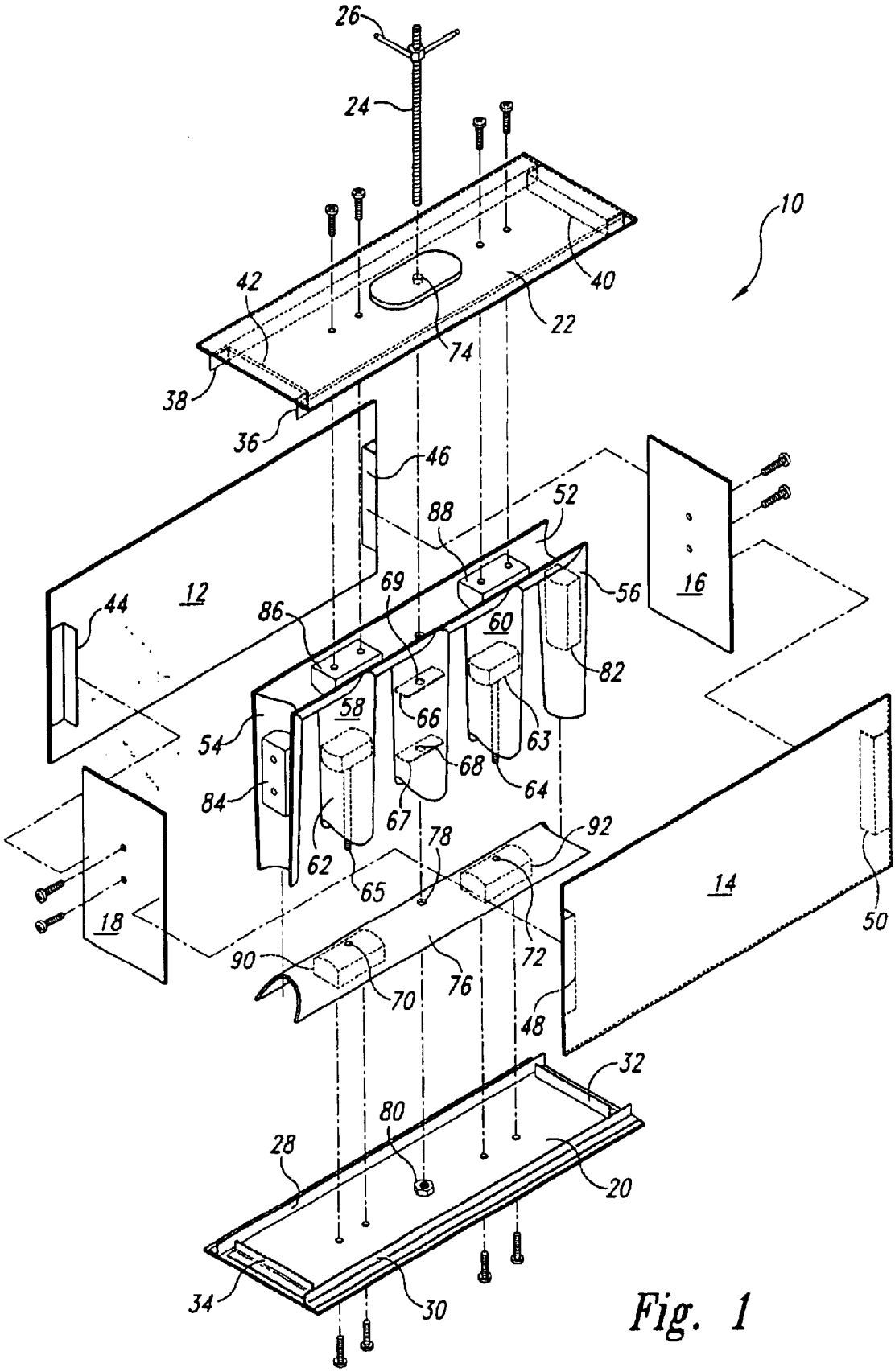
FIG. 1 is an exploded a perspective view of a mold for making foam blocks according to the present invention.

As best shown in FIG. 1, a mold 10 according to the present invention may comprise side plates 12, 14 and end plates 16, 18 that are mountable between bottom plate 20 and top plate 22. Preferably, the plates 12, 14, 16, 18, 20, 22 are made of steel having a thickness of ¼ inches (0.6 cm). Side retaining brackets 28, 30 and end retaining brackets 32, 34 are welded or otherwise affixed to the bottom plate such that the side plates 12, 14 such that the side plates 12, 14 can be positioned on the bottom plates 20 between the respectively associated side retaining brackets 28, 30 and the end retaining brackets 32, 34. When the side plates 12, 14 are in abutting relation with the side retaining brackets 28, 30, respectively, the distance between them is approximately equal to the width of the end plates 16, 18. As such, with the side plates in position on the base plate 20, the end plates 16, 18 may be inserted between the side plates 12, 14 in abutting relation with the end retaining brackets 32, 34 and the end retaining brackets 44, 46, 48, 50, which are mounted, as by welding, on the side plates 12, 14.

The top plate 22 is fashioned in similar manner, but in mirror image, to the bottom plate 20. Thus, the top plate has side retaining brackets 36, 38 and end retaining brackets 40, 42 attached to the lower surface thereof by welding or the like. The top plate 22 is configured to fit over the end plates 12, 14 and end plates 16, 18, with the side plates 12, 14 being retained against outward movement by the side retaining brackets 36, 38 and the end plates 16, 18 likewise being retained against outward movement by end retaining brackets 40, 42.

In order to provide voids in a block made using the mold 10, a plurality of void forms are mountable inside the cavity of the mold 10. These void forms comprise a top void form 52, end void forms 54, 56 and utility void forms 58, 60, all of which may be made from a plastic material such as ABS plastic or PVC plastic. The top void form 52 includes an aperture 53 for receiving the retaining rod 24. For easy release, the utility void forms 58, 60 are tapered inwardly from top to bottom. A center void form 61 is am mounted between the utility void forms 58, 60 and is likewise inwardly tapered from top to bottom to facilitate release of a block made in the mold 10. This void form 61 is preferably made of steel for added strength and resistance to deformation. Blocks 62, 63 generally conforming to the interior shape of the utility void forms 58, 60 are mounted inside the utility void forms 58, 60. These blocks may be held in place by press fitting, by adhesives, by screws or by other means. Pins 64, 65 depend from the blocks 62, 63. Aligning plates 66, 67 are mounted in the center void form 61 by welding or the like. These aligning plates 66, 67 have apertures 68, 69 formed along the central axis of the center void form 61 for receiving of the retaining rod 24.

A bottom void form 76 is also provided. This void form 76 includes apertures 70, 72 for receiving the pins 64, 65 which depend from the blocks 62, 63 in the utility void forms 58, 60 to align and position the utility void forms 58, 60 thereon. The bottom void form 76 also includes an aperture 70 positioned immediately above the nut 80 that is affixed to the bottom plate 20 by welding or the like. The lower ends of the utility void forms 58, 60 and the center void form 61 are contoured to conform to the shape of the bottom void form 76, and the upper ends of the utility void forms 58, 60 and of the center void form 61 are similarly contoured to conform to the top void form 52. The ends of the bottom void form 76 are contoured to conform to the shape of the end void forms 54, 56.

The top, end and bottom void forms 52, 54, 56, 76 are affixed, respectively, to the top plate 22, the end plates 16, 18, and the bottom plate 20. As shown in FIG. 1, this is accomplished for the top void form 52 by means of blocks 86, 88 which are affixed to the top void form 52 by adhesives, screws or the like, and which are in turn mounted to the top plate 22, again by adhesives, screws or the like. The end void forms 54, 56 are affixed, respectively, to blocks 82, 84 which, in turn, are connected to the respectively-associated end plates 16, 18. The bottom void form is affixed to the bottom plate in like manner through blocks 90, 92.

With the end, utility, center, and bottom void forms 52, 54, 56, 58, 60, 61, 76 assembled and the side plates 12, 14 and end plates 16, 18 mounted on the bottom plate 20, and preferably, with the retaining rod passed through the apertures 68, 69 in the aligning plates 66, 67, the aperture 78 in the bottom void form 76 and threadedly engaged with the nut 80 mounted on the bottom plate 20, and, after coating the interior of the mold 10 with a mold release compound, such as the Finishing Wax product available from Minwax Company of Flora, Ill., the mold 10 is ready to receive the urethane foaming material to make a block. Any of a variety of urethane foaming materials may be used. One two-part foaming system that has been found to perform well is the polyurethane foam system available from Resin Technology Co. of Ontario, Calif. This system is a two-part system in which equal parts of two different fluid components are mixed together. The mixture may then be poured into a mold, where it will foam and expand, assuming a sufficient amount has been used, to fill the mold.

With the mold prepared as described above, the mixture may be poured into the mold, and the top plate 22 may be secured in place. In order to do this, the user should ensure that side plates 12, 14 are positioned inwardly of the retaining brackets 36, 38 to secure them against lateral movement away from one another. The end retaining brackets 40, 42 of the top plate 22 restrain the end plates 16, 18 against movement away from one another, as do the end plate retaining brackets 44, 46, 48, 50 which are mounted on the side plates 12, 14. The retaining rod 24 passes through the aperture 53 in the top void form 52 and the aperture 74 in the top plate 22 and is used to secure the top and bottom plates 22, 20 from movement away from one another by means of a wing nut 26 which is threadedly engaged with the retaining rod 24. It should be noted that the expanding foaming material can develop significant pressure within the mold 10.

Figure 2A:
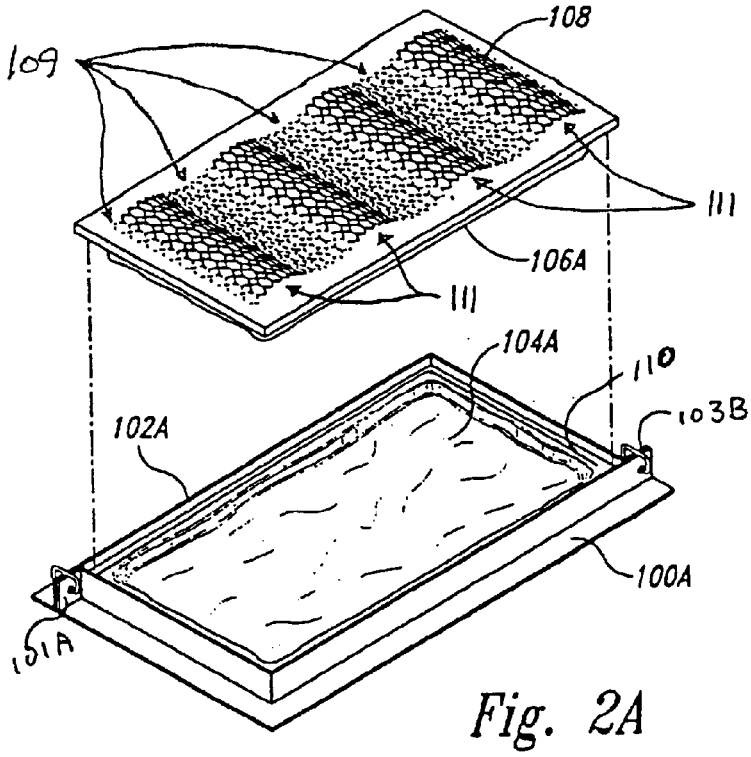
FIG. 2A is a perspective view of molds for making facings for use in the present invention.

While a block produced by the mold 10 may be used without any facing, in one embodiment of the invention, facings are provided on the blocks. Referring to FIG. 2A, such a facing 106 may be made from a cementitious material, such as cement, using a mold. The mold comprises first and second frame members 100A, 102A, each of which comprises two pieces of angle iron joined as by welding to form and L-shaped piece. Tabs 101A, 103A are mounted at one end of one of the pieces of angle iron comprising the frame members 100A, 102A, permitting the two frame members to be clamped together about a facing mold 104A. The facing mold 104A may be made out of a variety of materials, such as plastics, but in this embodiment is made of fiberglass in and epoxy or polyester resin. A shoulder 110 in the facing mold 104A is used to form a thin flange 112 about the periphery of the facing 106A.

In order to ensure that the mold 104A produces a planar, untwisted facing, the mold 104A may be pressed into level, wet concrete, and one of the side plates 12, 14 may be laid on top of it until the concrete has cured. The frame members 100A, 102A may then be clamped together about the mold 104. A cementitious material such as Portland cement may then be poured into the mold. In one embodiment, wire mesh 108A is bent into an undulating form and is partially embedded in the cementitious material. The wire mesh may be a material such as chicken wire. As shown in FIG. 2A, the wire mesh 108 is a non-planar mesh member having a plurality of first portions 109 embedded within the facing layer 106A (shown in lighter, dashed lines to depict embedded portions of the mesh 108), and a plurality of second portions 111 (shown in darker lines) that become embedded within a molded block during the molding process, as described more fully below.

Figure 2B:
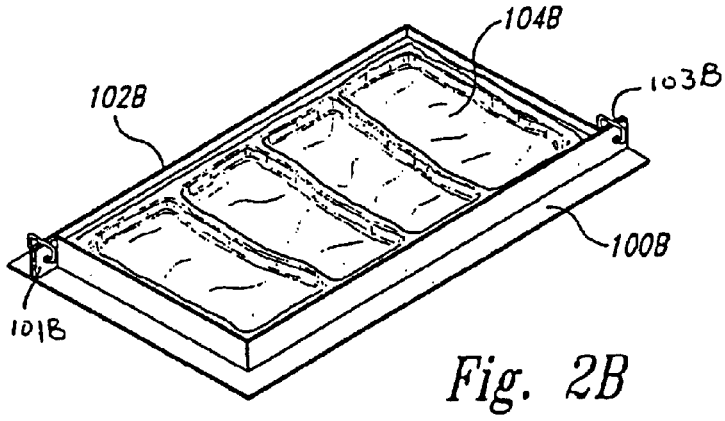
FIG. 2B is a perspective view of molds for making facings for use in the present invention.
Figure 2C:
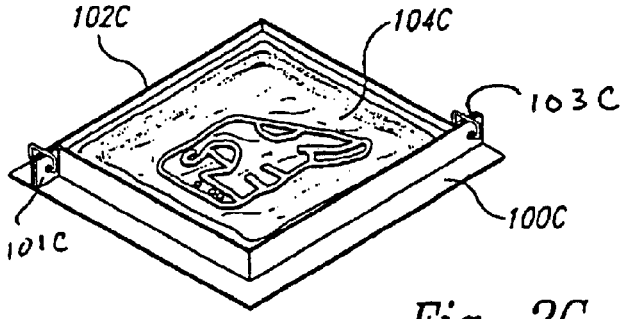
FIG. 2C is a perspective view of molds for making facings for use in the present invention.

FIG. 2B illustrates another facing mold usable with the present embodiment of the invention. FIG. 2C illustrates a similar mold a 104C which is half the size of the molds of FIGS. 2A and 2B.

Figure 3:
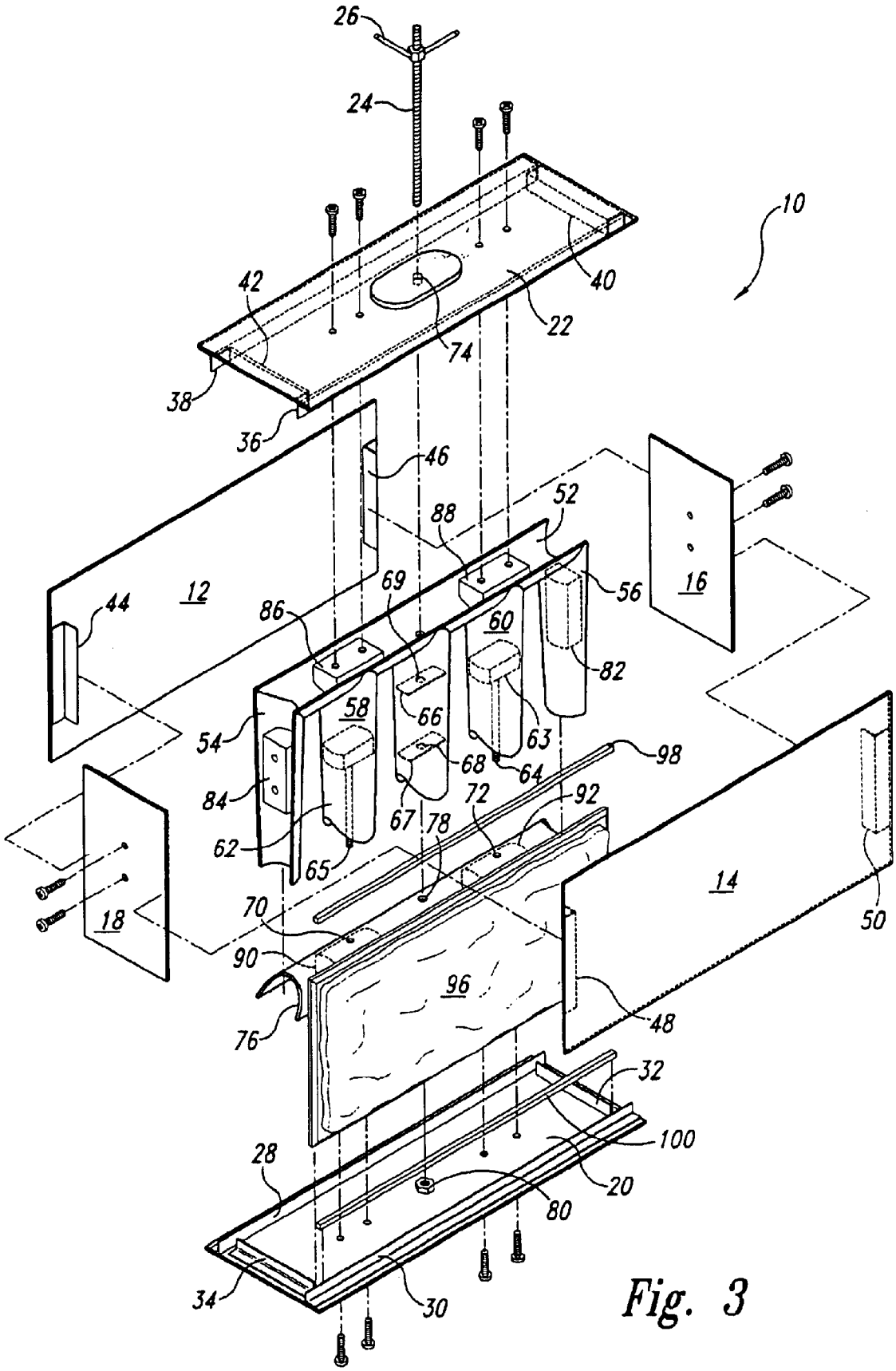
FIG. 3 is an exploded a perspective view of a mold according to the present invention showing the insertion of a facing into the mold.

With reference to FIG. 3, a facing 96, with or without wire mesh 108 embedded therein (e.g. a plurality of first portions 109 embedded in the facing 96 as shown in FIG. 2A) may be bonded to a block by positioning it in the mold 10 before the foaming mixture is added to the mold 10. As shown, the outwardly facing surface of the facing 96 is irregular. Thus, if the irregular surface of the facing 96 were to be pushed into contact with the side plate 14 by the pressure of the expanding foam within the mold 10, it is possible that the facing 96 might crack. In order to avoid that, spacers 98, 100 are placed between the flange 112 of the facing 96 and the side plate 14 along the upper and lower edges of the facing 96. The size and shape of these spacers 98, 100 is chosen to provide a small gap between the facing 96 and the side plate 14 as well as to provide a small gap between the upper and lower edges of the facing 96 and the top and bottom plates 20, 22 of the mold 10.

In order to make a block including a facing 96, the side plates 12, 14 and end plates 16, 18 are positioned on the base plate 20. The facing 94 and facing supports 96, 98 are positioned immediately behind the side plate 14. The mixture for the urethane foam may then be poured into the mold and the top plate 22 may then be secured in place by the wing nut 26 on the retaining rod 24. Once the two components of the foaming system have been mixed, the foam is generated very rapidly, and fills the interior of the mold 10. If the facing 94 includes the exposed wire mesh 108, the expanding foam penetrates the mesh 108 to provide a superior mechanical hold on the facing 94. More specifically, the plurality of second portions 111 of the non-planar mesh member 108 (FIG. 2A) become embedded within the molded block. However, it has been discovered that the two-part urethane foam system produces a foam which adheres sufficiently strongly to the back of a cementitious facing 94 that the embedded mesh 108 may not be necessary.

Depending on temperature and humidity, the block produced by the mold 10 will have cured sufficiently to remove the block from the mold 10 within about ten minutes. Once the wing nut 26 has been removed from the retaining rod 24, the top panel 22 may be lifted off the remaining components of the mold 10, and the side plates 12, 14 and end plates 16, 18 may be removed. Tabs, notches, holes or other means (not shown) may be provided on the side plates 12, 14 and end plates 16, 18 to allow them to be pried upward from the bottom plate 20.

Figure 6:
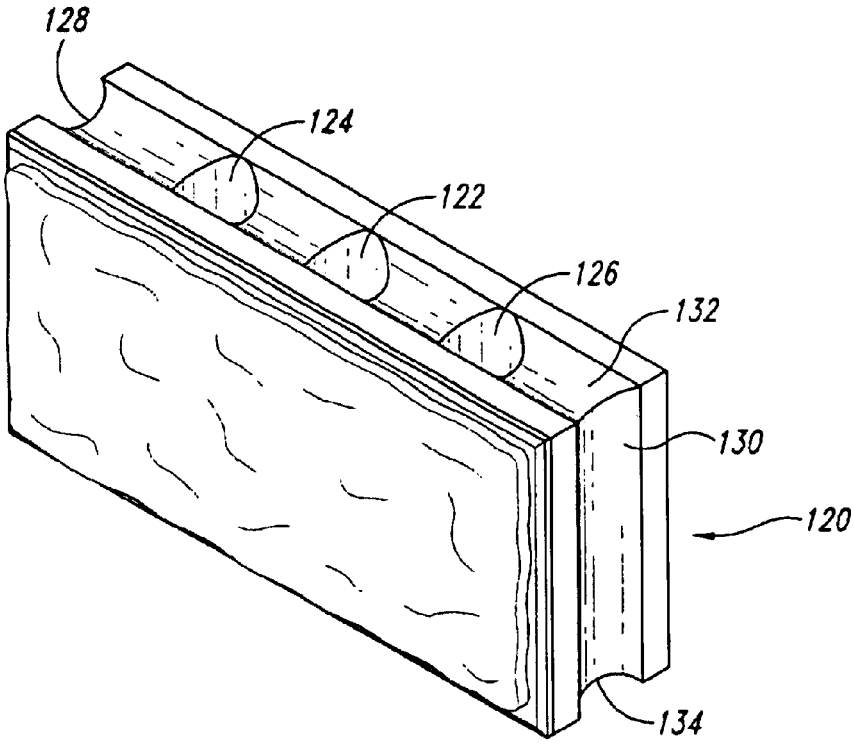
FIG. 6 is a perspective view of a block according to the present invention.

As shown in FIG. 6, and as previously discussed, the block 120 includes a center void 122, two utility voids 124, 126, two hemi-cylindrical end voids 128, 130 and hemi-cylindrical top and bottom voids 132, 134. The facing 96, which bonded to the urethane foam material of the block 120 in the mold 10, and which may include the further mechanical bond resulting from loops of chicken wire or other wire mesh 108, as shown in FIG. 2A, is intended for use on the exterior of the structure constructed with the blocks 120.

Figure 4:
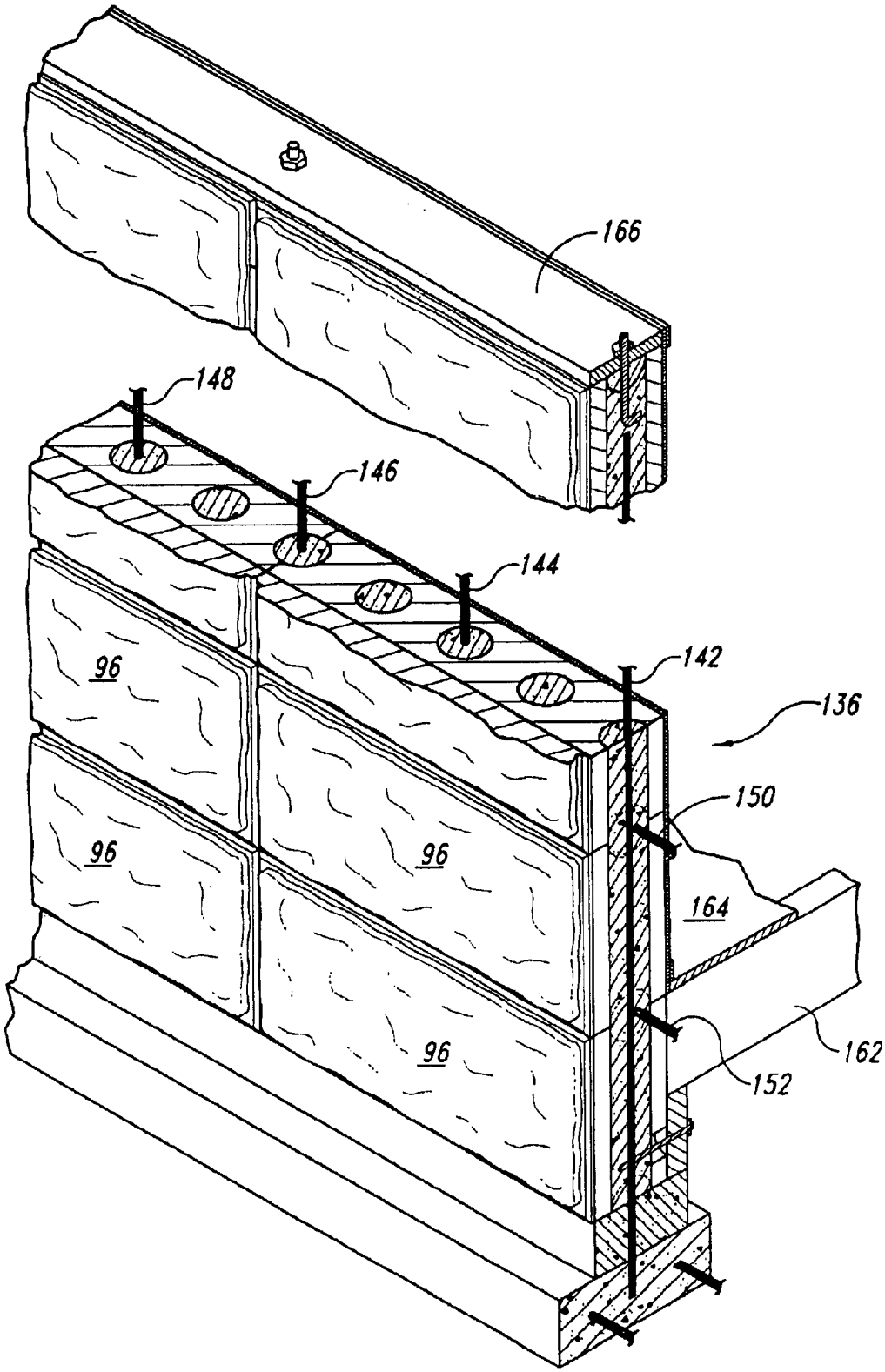
FIG. 4 is an isometric view of a wall structure of the present invention.

Referring to FIG. 4, a wall 136 may be made by stacking the blocks 120 directly on top of one another. Alternatively, the blocks 120 could be staggered such that the center void 122 of a block 120 in a first course is axially aligned with the cylindrical void formed by the hemi-cylindrical end voids 128, 130 of two abutting blocks 120 positioned immediately thereabove. Preferably, the first course of blocks 120 is laid on a concrete footing 138 and bottom plate 140. It is important to that the first course of blocks 120 be laid such that the upper surfaces of the blocks 120 are level and coplanar. To that end, shims (not shown) of wood or other material may be placed under the blocks 120 to achieve the desired alignment.

Rebar 142, 144, 146, 148, which is set vertically in the foundation, extends upwardly through the end voids 128, 130 and center voids 122 of the blocks. Horizontally-extending rebar 150, 152 is positioned in the hemi-cylindrical top voids 132 of the blocks 120 in each course. The vertical rebar 142, 144, 146, 148 and horizontal rebar 150, 152 may be secured together by wire ties as is known in the art. The blocks 120 may be held in place on the bottom plate 140 and to neighboring blocks by use of a construction adhesive such as that sold under the SF-450 PRO SERIES trademark by Ohio Sealants, Inc. of Mentor, Calif. In addition to the use of the aforementioned adhesive, the blocks 120 may be maintained in place by using wire ties, together with small pieces of concrete or the like to secure the blocks 120 against upward movement relative to the vertical rebar 142, 144, 146, 148 when the voids are filled with concrete.

Figure 5:
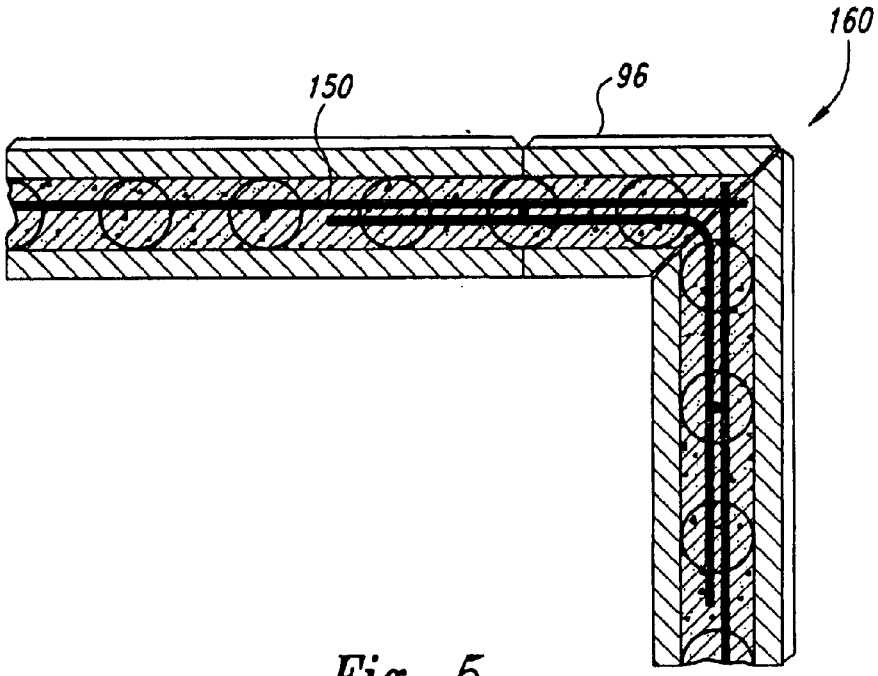
FIG. 5 is a top plan is view of a partially constructed wall showing replacement of rebar in the horizontal channels in the blocks.

Referring next to FIG. 5, half-sized facings 96, such as those made in the mold 104C of FIG. 2C may be used where only half a block 120 is required. A full-size facing 96, of course, may be cut in half using an appropriate abrasive cutter or by other such means. The urethane material of the blocks 120 may be cut at an angle as shown in FIG. 5 to facilitate the formation of a corner 160 in the wall 136.

Preferably, concrete is poured into the voids in the blocks 120 after the laying of one or more courses rather than after the construction of the entire wall. This permit us the worker is pouring a concrete to ensure that all of the voids in the blocks 120 are filled with concrete. This also lessens the tendency of the blocks to float when the concrete is poured into the voids.

Windows and doors formed in the wall 136 may be framed with boards to prevent the lateral flow of concrete out of the voids. As shown in FIG. 4, floor joists 162 and flooring 164 may be added in a conventional manner.

Blocks 120 may be made without facings 96 and such blocks may be used for non-load-bearing interior walls, in which concrete and rebar may be used or not use as the builder may select. A top plate 166 may be secured atop the wall 136 by anchor bolts 168 embedded in the concrete and the like. Wallboard may be affixed to the interior of the walls 136 by means of construction adhesive, by means of screws extending into lath that is affixed to the wall 136, and by a variety of other known means. Pipes and electrical conduit, or void forming means for such pipes and conduits may be run through the utility voids 124, 126 prior to the pouring of the concrete. Alternatively, pipes and wiring can be run through channels formed in the foam of the blocks 120 as by cutting or scraping once the concrete has set.

Other external finishes may be provided on a wall 136 constructed from the blocks 120. For example, if blocks 120 without facings 96 are used, wire ties and such as those used to secure pieces of rebar together could be extended outward from the rebar between courses of blocks. Wire mesh could then be suspended from the ties and stucco could be applied to the wall and wire mesh to provide a stucco finish to the wall 136.

The detailed descriptions of the above embodiments are not exhaustive descriptions of all embodiments contemplated by the inventors to be within the scope of the invention. Indeed, persons skilled in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part to create additional embodiments within the scope and teachings of the invention.

Thus, although specific embodiments of, and examples for, the invention are described herein for illustrative purposes, various equivalent modifications are possible within the scope of the invention, as those skilled in the relevant art will recognize. The teachings provided herein can be applied to other systems, methods and apparatus, and not just to the embodiments described above and shown in the accompanying figures. Accordingly, the scope of the invention should be determined from the following claims.

What is claimed is:

1. A foam construction block, comprising:

a rectangular molded block of foam forming at least one horizontally-extending void and at least one vertically-extending void, at least one of the vertically-extending voids extending between the top and bottom surfaces of said block, and at least one of the horizontally-extending voids extending between the side surfaces of said block, at least one of said horizontally-extending voids intersecting at least one of said vertically-extending voids; and an outer member including a facing layer adapted to substantially cover an exterior surface of the molded block and a non-planar mesh member having a plurality of first portions embedded within the facing layer and a plurality of second portions embedded within the molded block, the outer member being bonded to an exterior surface of said block during the molding of the block.

2. The foam construction block of claim 1 wherein said facing comprises two facing pieces adhered to said block of foam in abutting relation, such that said block of foam is cut transversely into two pieces, each of which has one of said facing pieces adhered thereto.

3. The foam construction block of claim 1 wherein said mesh member comprises a wire mesh.

4. The foam construction block of claim 3 wherein said wire mesh comprises chicken wire.

5. The foam construction block of claim 1 wherein said block of foam comprises urethane foam.

6. A foam construction block, comprising a molded block of foam, said block having first and second ends, first and second side faces, and upper and lower faces, and having at least one horizontally-extending void formed along one of the upper and lower surfaces and extending between said end faces, and having a facing member including a facing layer adapted to substantially cover an exterior surface of the molded block and a non-planar mesh member having a plurality of first portions embedded within the facing layer and a plurality of second portions embedded within the molded block, the facing member being attached to the block of foam simultaneously with the molding of the block of foam.

7. The block of claim 6 wherein said foam block is a urethane foam block.

8. The block of claim 6 wherein the facing consists of cement.

9. The block of claim 8 wherein said foam block is a urethane foam block.

10. The foam construction block of claim 1 wherein said facing consists of cement.

11. The foam construction block of claim 1 wherein the block further includes at least one tapered void formed in the block body and extending between the upper and lower surfaces.

12. The block of claim 6 wherein at least one of the vertically-extending voids comprises a tapered void.

13. The block of claim 6 wherein said mesh member comprises a wire mesh.

14. The block of claim 13 wherein said wire mesh comprises chicken wire.

15. The block of claim 6 wherein the block has at least one tapered void formed in the block body and extending between the upper and lower surfaces.

16. A construction block, comprising:

a molded block of polymeric material; and an outer member including a facing layer adapted to substantially cover an exterior surface of the molded block and a non-planar mesh member having a plurality of first portions embedded within the facing layer and a plurality of second portions embedded within the molded block, the mesh member thereby securing the outer member to the molded block.

17. The construction block of claim 16 wherein the non-planar mesh member comprises an undulating metallic mesh member.

18. The construction block of claim 16 wherein the non-planar mesh member comprises an undulating wire mesh member.

19. The construction block of claim 16 wherein the non-planar mesh member is approximately co-extensive with the facing layer.

* * * * *